US005143240A

United States Patent [19]

Timson

[11] Patent Number: 5,143,240

[45] Date of Patent: Sep. 1, 1992

[54] CAN CONSTRUCTION

[75] Inventor: William J. Timson, Pocassett, Mass.

[73] Assignee: Wellesley Research Associates, Inc., Wellesley, Mass.

[21] Appl. No.: 722,525

[22] Filed: Jun. 27, 1991

Related U.S. Application Data

[63] Continuation-in-part of Ser. No. 606,564, Oct. 31, 1990, Pat. No. 5,027,968.

[51] Int. Cl.[5] ..... B65D 17/00

[52] U.S. Cl. ..... 220/260; 220/269; 220/277

[58] Field of Search ..... 220/269, 268, 285, 375, 220/379, 260, 277; 215/289, 306

[56] References Cited

U.S. PATENT DOCUMENTS

| | | | |
|---|---|---|---|
| 394,490 | 12/1888 | Howe | 215/289 X |
| 749,674 | 1/1904 | Hoffman | 215/289 X |
| 3,318,495 | 5/1967 | Roberts | 220/270 X |
| 4,167,234 | 9/1979 | Gordon et al. | 220/270 X |
| 4,289,250 | 9/1981 | Jordan | 220/270 X |
| 4,755,356 | 7/1988 | Robbins et al. | 220/375 X |
| 4,756,442 | 7/1988 | Halm et al. | 220/375 X |
| 4,762,246 | 8/1988 | Ashley et al. | 220/270 |
| 5,027,968 | 7/1991 | Timson | 220/269 |

*Primary Examiner*—Steven M. Pollard
*Attorney, Agent, or Firm*—Paul J. Cook

[57] ABSTRACT

A container is provided with a top to which is secured at least one strip. The strip or strips are provided with a prestress bias so that when the top is severed from the container, the strip or strips are lifted away from the top and over the container rim so that the strip can be grasped easily to provide a means for lifting the top away from the container.

24 Claims, 4 Drawing Sheets

CAN CONSTRUCTION

REFERENCE TO RELATED APPLICATION

This application is a continuation-in-part of copending application Ser. No. 606,564, filed Oct. 31, 1990, now U.S. Pat. No. 5,027,968.

BACKGROUND OF THE INVENTION

This invention relates to a container construction comprising a container having a sealed cover which can be manually removed from said container when the cover is severed from the container. More particularly, this invention comprises a container construction for a liquid having a cover which includes strip means which promotes ease of manual removal of the cover from the container when the cover is severed from the container prior to the cover sinking into the liquid.

Prior to the present invention, containers such as metallic or plastic containers have been provided with a cover which can be opened by hand. These containers included the construction having a "pop-top" opener handle which is formed integrally with the cover and can be lifted by hand to form an opening in the cover which is defined by a previously molded indentation in the cover. These containers have been designed either to form a centrally located opening in the cover such as is common in a beverage container or can be found to extend about the cover periphery to remove the cover, as is common in processed foods such as cheese products. The opener handles which form a central opening are not desirable for use with a liquid food product since a portion of the outside surface of the opened handle extends into the liquid and can contaminate the liquid. The handle openings which permit removal of the entire cover are expensive.

It has also been proposed in U.S. Pat. No. 2,637,465 to provide a handle which can be bent away from a can top so that the can top can be subsequently lifted away from the can after the top has been cut. This handle means is undesirable since force is required to bend it away from the can which force would force the contents onto the top after it is cut. In addition, it is expensive to produce.

It would be desirable to provide a container construction which includes a cover which can be easily manually removed from the container when the cover is severed without interfering with the container's contents such as by causing the cover to sink into the container as is in the case of liquid products such as soups.

SUMMARY OF THE INVENTION

The present invention provides a container construction with a top having a handle in the form of a strip or a plurality of strips which are covered by a severable cover. The strips are prestressed and secured to the container in a manner such that when the container top and cover are cut about their periphery when opening the container, the strip or strips, under the prestressing forces, lift away from the container top and extend over the container rim to a position where they can be easily grasped. The cover can enclose the entire top to protect the can top from dust and soil or enclose only a portion of the top which includes the strips. By extending the strips over the container rim, they can be manually grasped while avoiding exerting downward force on the opened container top. The requirement of manual force to lift the strips away from the container is eliminated so the container contents are not disturbed when the top is removed from the container. The strips are adhered to a portion of the exposed top surface while an end of each strip is rendered free from the surface when the top and cover are cut so that it can be manually grasped after the top is cut away from the container body.

DESCRIPTION OF SPECIFIC EMBODIMENTS

Figure 1:
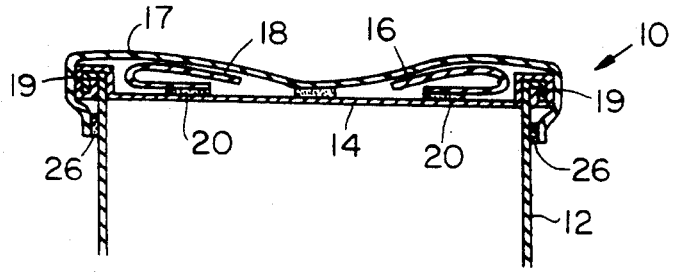
FIG. 1 is a cut-away view of a container top with a cover and strip adhered to the top periphery.

By the term "strip" as used herein is meant an element having a flat surface such as a portion of a sheet or foam material or a curved surface such as filament which has a length such that it can be grasped manually. The strip is formed of a material which is elastic and can be prestressed so that when it is released from the forces which cause it to remain stationary, it moves, under the prestressing forces, away from the container top and over the container rim. For example, the strip can be formed of a polymeric composition such as a rubber, a solid, or a plastic foam composition, from a metallic composition, or from a plastic composite materials such as plastic-graphite, plastic-metal, plastic-glass, etc.

The container top of this invention includes one or more strips, usually a plurality of strips which are secured, at one end thereof to a central portion of the top or to a cover which extend over the strip and the top and the second end thereof being free. The cover is secured near the top periphery so that it can be cut with a cutting tool used to open the container. Since the strip is prestressed and the first end of the strip is secured to a central portion of the top or to the cover, when the cover is cut, the strip extends over the container rim due to the prestressed bias previously imposed into the strip. It is to be understood that any means for inducing the prestressed bias into the strip can be utilized in the present invention including natural elasticity of the material and prebending. In any event, the means for adhering the strip and cover is positioned on the top surface so that a strip can extend over the container rim so that it can be be easily grasped when it is desired to remove the can top from the can body. The cross patch which has the permanent adhesive maintains the strip on the can top.

Elastic bi-compositional and multicompositional covers may be utilized over the strip and may be composed of a less shrinking bottom layer and a more-shrinking upper layer. Differential shrinking can be achieved by many means including chemical cross-linking, thermal shrinking, plasticiser loss, aging or the like.

To obtain a length-stable bottom layer of the cover, the bottom layer can be made of a suitable metal, such as stainless steel, aluminum, iron, copper alloys or a suitable dimensionally stable plastic, such as polysulfone, polycarbonate, polyimide, polyethermide or polyester. The upper layer can be formed of a shrinkable polymer that shrinks to a desired amount to give the desired pre-stressed curl to the cover such as heat treatment, including polyolefins such as polyethylene or polypropylene, polyethylene, vinyl acetate and other copolymers, polystyrene, butadiene, polyvinylidene chloride. The bottom and top layers of the cover can be co-extruded and can be laminated. Alternatively, fibers, of lower and higher thermal shrinking can be sandwiched to a polymer strip to provide the desired cover bending.

Stressing of the cover sheet also can be achieved by differential contraction of a bi-compositional sheet which has more shrinkage on the upper layer than on the bottom layer when the sheet is heated. during steam sterilization or other heat application. Multilayered sheet compositions utilizing this feature also can be used. Alternatively, a sheet of a single polymeric composition can be shrunk on the upper surface by a rapid heat pulse such shrinkage on one surface of the sheet to provide desired prestressing for sheet curling.

Curling of the cover, causing the cover to bias away from the can top, allows one to also easily grasp the cover sheet so that the can top can be easily lifted manually away from the container body by either the cover sheet or the strip.

Figure 3:
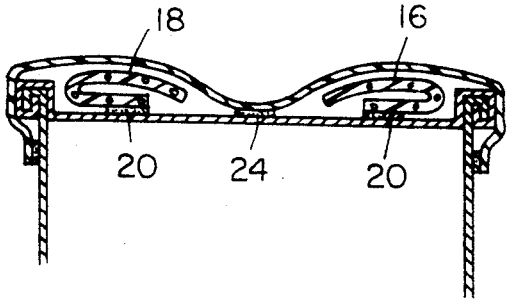
FIG. 3 is a cut-away view of a container top with foam strips adhered to the top periphery.
Figure 5:
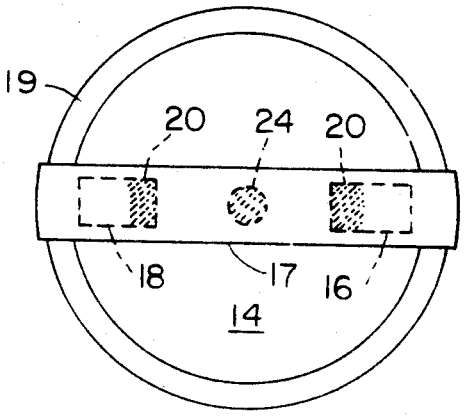
FIG. 5 is a top view of the container top of FIG. 1.

Referring to FIGS. 1, 3 and 5, the container 10 of this invention includes a container body 12, a sealed top 14, a cover 17 such as sheet plastic and strips 16 and 18. Strips 16 and 18 are secured to a top 14 such as with an adhesive 20 or solder 20. The cover is preferably secured to the can top 14 at 24 and container 26. The strips 16 and 18 are prestressed so that when the cover is cut at its periphery when the can top 14 is cut about its periphery 15, the strips 16 and 18 are biased away from the top 14 to extend over the container rim 19 and can be easily grasped while also preventing the can top from sinking into the liquid contents of the can. Thus, the top 14 can be easily lifted manually away from the container body 12 by gripping the free end of a strip 18 or the severed cover 27.

Figure 2:
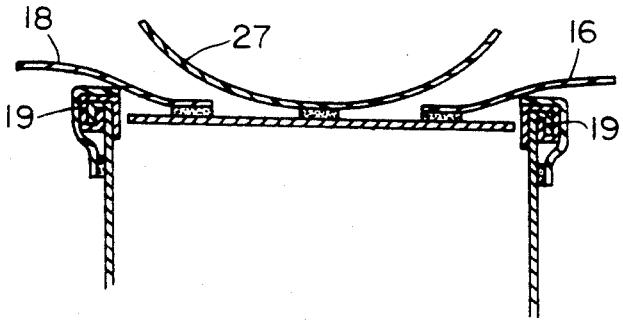
FIG. 2 is a cut-away view of a container top of FIG. 1 after the cover and top have been severed.

As shown in FIG. 2, the strips 16 and 18 are prestressed so that they extend beyond the container rim 19 after it is cut. The strips also can have ridged surfaces rather than flat surfaces to improve handling.

Figure 4:
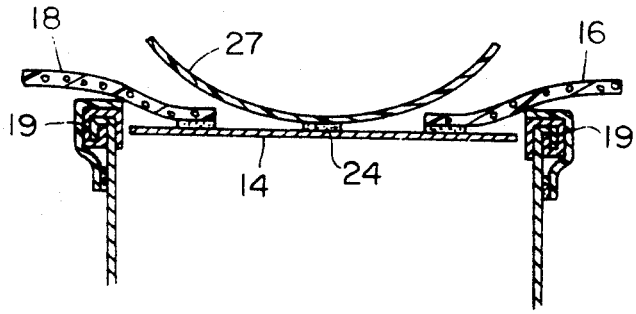
FIG. 4 is a cut away view of a container top of FIG. 3 after the cover and top have been cut.

In an alternative construction as shown in FIG. 3, the strips 16 and 18 are formed of a foam material and are secured to the top 14 by an adhesive 20. The cover 17 is secured to top 14 by adhesive 24. When the can top 14 is cut, the foam strips 16 and 18 assume the configuration shown in FIG. 4.

Figure 7:
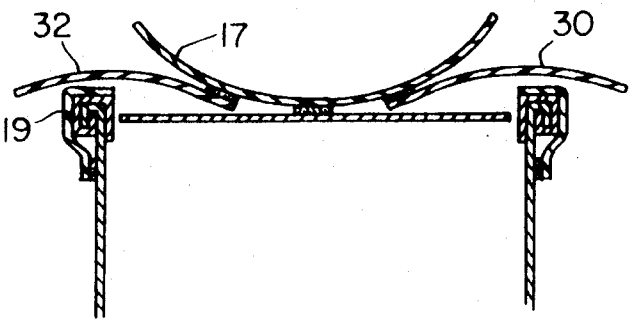
FIG. 7 shows the container of FIG. 6 after the cover and top have been cut.
Figure 6:
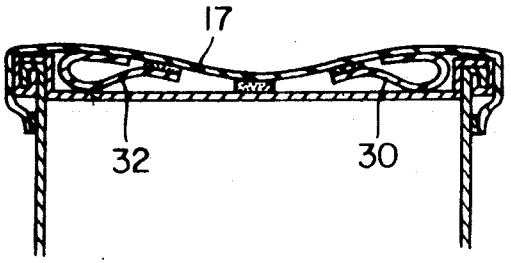
FIG. 6 is a cut away view of a container with strips adhered to a cover.

An alternative strip design is shown in FIG. 6 where strips 30 and 32 are adhered to cover 17. When the can top 14 and cover 17 are cut, the strips 30 and 32 assume the position shown in FIG. 7 so that they extend over the container rim 19. The attachment of the strips to cover 17 may also be as shown in FIGS. 8 and 9 although the one in FIG. 6 is preferred.

Figure 9:
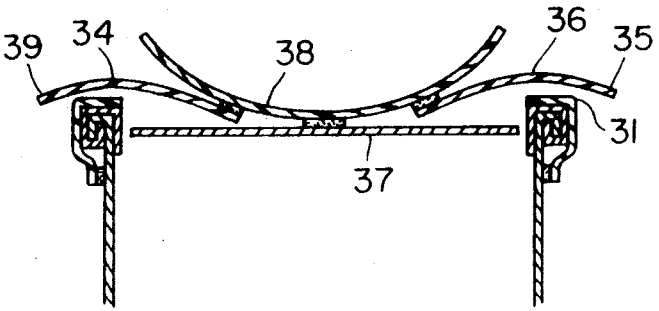
FIG. 9 shows the container top of FIG. 8 after the cover has been severed.
Figure 8:
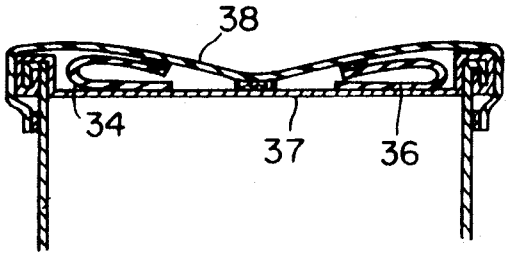
FIG. 8 shows an alternative form of this invention with one strip secured with an adhesive to the cover.

As shown in FIGS. 8 and 9, the strips 34 and 36 can be adhered to the cover 38 such that when top 37 and cover 38 are severed, the free ends 35 and 39 extend over the peripheral rim 31.

Figure 10:
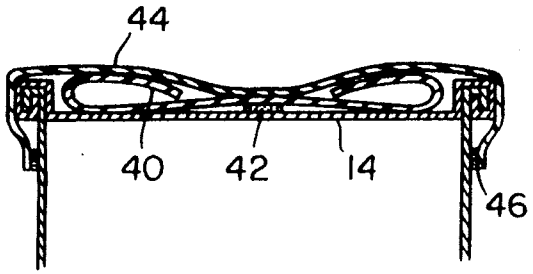
FIG. 10 is a cut-away view of a container with the strips adhered to the container top.

As shown in FIG. 10, the strip 40 and cover 44 may be adhered with adhesive 42 to can top 14 and one end cover 44 is adhered to the container 12 by adhesive 46.

For strips attached to can top 14, e.g., FIGS. 1,3) attachment 24 of cover to top 14 is described but not essential.

Figure 11:
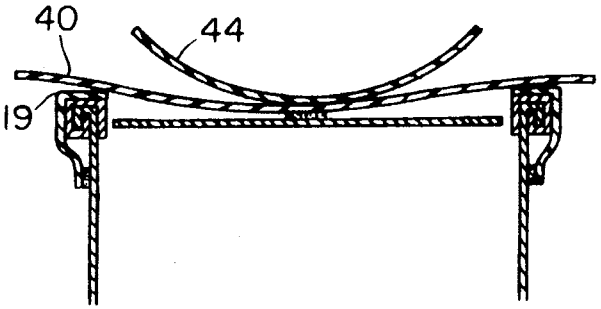
FIG. 11 is the container of FIG. 10 after the strips are cut.

Referring to FIG. 11, after the cover 44 is cut, the strip 40 extends over container rim 19 to promote ease of manual grasping.

Figure 13:
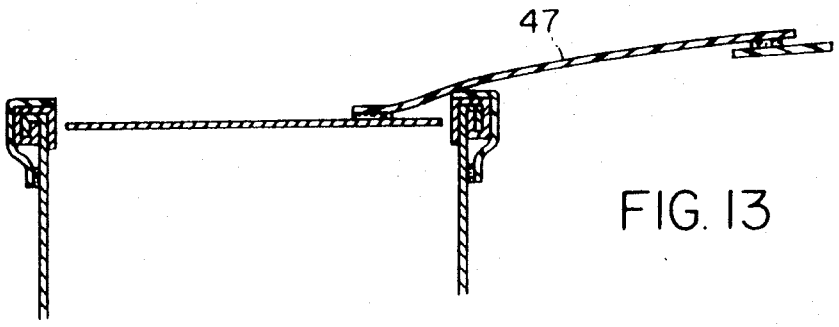
FIG. 13 shows the container of FIG. 12 after the cover is cut.
Figure 12:
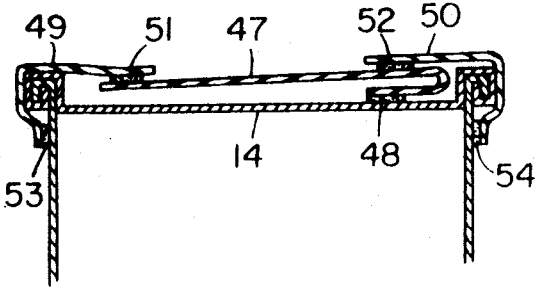
FIG. 12 shows a container of this invention with one strip.

An alternate strip design is shown in FIGS. 12 and 13 where one strip is shown, although more than one strip may be used on a can top. The strip 47 is adhered to top 14 at 48 and to covers 49 and 50 at 51 and 52. The covers 49 and 50 are also adhered to can 12 at 53 and 54. When the covers are cut during the severing of the can top, the prestressed strips are biased away from the container top and assume the position shown in FIG. 13, thus providing an extra long strip for easy grasping of the strip.

Figure 15:
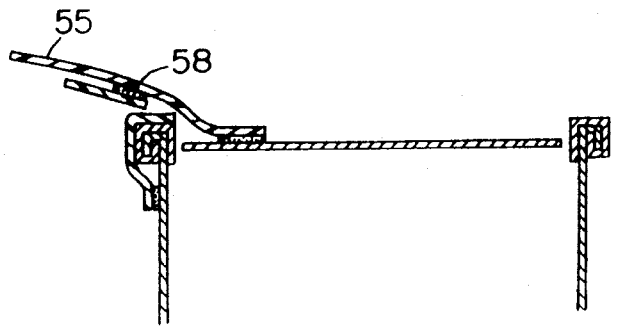
FIG. 15 is the container of FIG. 14 after the cover is cut.
Figure 14:
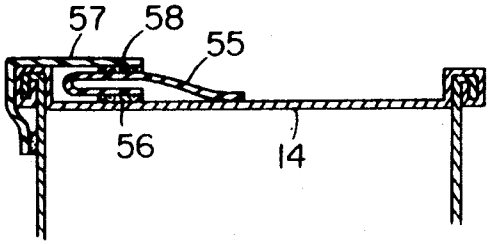
FIG. 14 shows a container of this invention with one strip.

An alternate strip design is shown in FIGS. 14 and 15, where one strip is shown although more than one strip may be used on a can top. The strip 55 is adhered to top 14 at 56 and to a rigid restraining cover 57 at 58 which keeps the strip restrained from biasing away from the container. When the cover is cut during the severing of the can top, the prestressed strip is biased away from the container top and assumes the position shown in FIG. 15.

Figure 17:
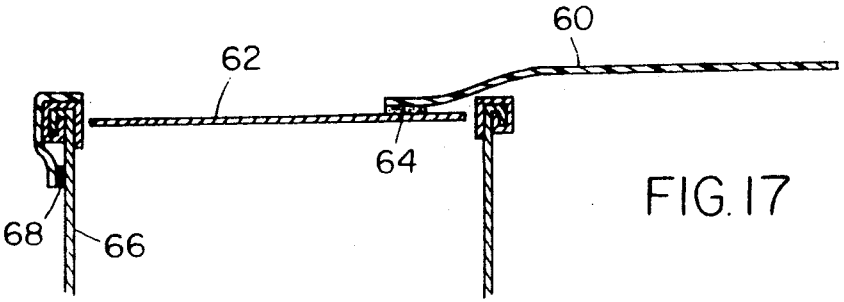
FIG. 17 shows the container of FIG. 16 after the strip is cut.
Figure 16:
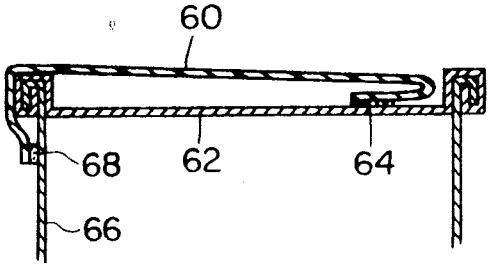
FIG. 16 shows a container of this invention with one end of the strip adhered to the container side and the other end to the top.
Figure 18:
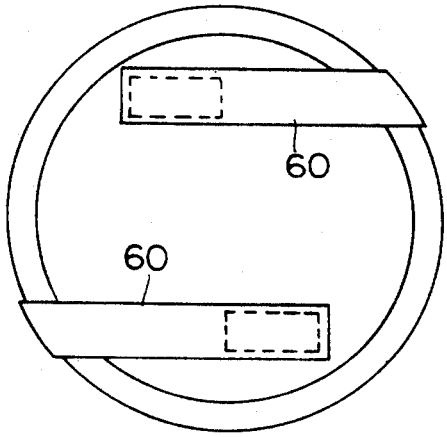
FIG. 18 is a top view of a container with two strips as shown in FIGS. 16 and 17.

Referring to FIGS. 16 and 17, a strip 60 is adhered to the can top 62 by an adhesive 64 at one end and at the opposite end to the container side 66 by adhesive 68. After the can top 62 and strip 60 are severed, the free end 69 of the strip 60 can be easily grasped. As shown in FIG. 18, two strips 60 as shown in FIGS. 16 and 17 can be adhered to the container top 62.

Figure 19:
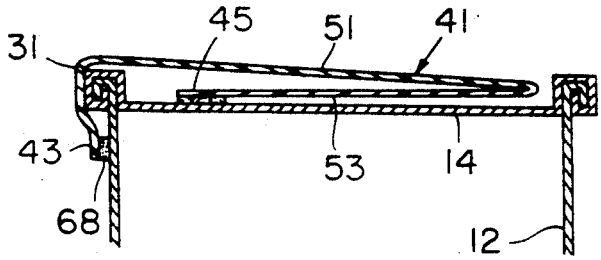
FIGS. 19 and 20 show an emobiment with no cover and one prestressed strip.
Figure 20:
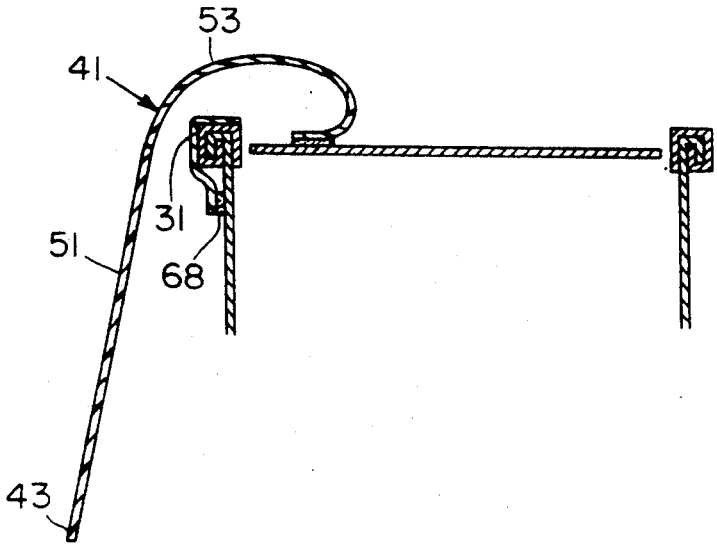

Referring to FIGS. 19 and 20, the strip 41 is secured at one end 43 to can 12 at 68 and at a second end 45 to top 14. When the top 14 and strip 41 are cut, the end of strip 51 extends over the rim 31. The strip 41 has two sections; a rigid section 51 and a prestressed elastic section, 53. Securing at 68 may be with adhesive or by crimping.

It is to be understood that a first end of the strip can be adhered to the top, or when used, the cover. The second end can be free or restrained in any manner, so long as when the top is severed, the prestressing in the strip effects positioning of the strip as described above.

Although it may be more expedient to utilize a curling (prestressed) cover sheet, a non-curling conventional plastic sheet cover may also be used to keep the strips in place. The cover sheet may also be a stretched elastomeric polymer sheet, if desired.

As long as the cover can restrain the strips, it can function satisfactorily even without adhesive attachment of cover to center of can top.

It is claimed:

1. A sealed container having, a side wall, a peripheral rim and a permanently fixed top to a body having a volume containing a material, a cover positioned over said fixed top, at least one strip means positioned on said top having a first end adhered either to said fixed top or to said cover and the second end adhered to said sidewall, said at least one strip having a stress bias such that when said top is severed from said container, one end of said strip becomes positioned away from contact with said top and extends outwardly away from said peripheral rim thereby supporting said can top and preventing said top from sinking into the material.

2. The container of claim 1 which includes a plurality of said strip means.

3. The container of any one of claims 1 or 2, wherein said strip means comprise a metallic strip.

4. The container of any one of claims 1 or 2, wherein said strip means comprise a polymeric material.

5. The container of any one of claims 1 or 2, wherein said strip means comprises a polymeric filament.

6. The container of any one of claims 1 or 2, wherein said strip means comprises a metallic filament.

7. The container of any one of claims 1 or 2, wherein said strip means comprises a composite material of polymer and non polymer fibers.

8. The container of any one of claims 1 or 2, wherein said strip means has flat surfaces.

9. A sealed container having a side wall, a peripheral rim and a permanently fixed top to a body having a volume containing a material, a cover positioned over said fixed top, at least one strip means positioned between said top and said cover, said strip means having one end attached either to said cover or said top, said at least one strip having a stress bias such that when said top is severed from said container, one end of said strip becomes positioned away from contact with said top and extends outwardly away from said peripheral rim thereby supporting said can top and preventing said top from sinking into the material.

10. The container of claim 9 which includes a plurality of said strip means.

11. The container of any one of claims 9 or 10, wherein said strip means has flat surfaces.

12. The container of any one of claims 9 or 10, wherein said strip means comprise a metallic strip.

13. The container of any one of claims 9 or 10, wherein said strip means comprise a polymeric material.

14. The container of any one of claims 9 or 10, wherein said strip means comprises a polymeric filament.

15. The container of any one of claims 9 or 10, wherein said strip means comprises a metallic filament.

16. The container of any one of claims 9 or 10, wherein said strip means comprises a composite material of polymer with non-polymeric fibers.

17. The container of any one of claim 9 or 10 wherein the severable cover secured near the top periphery of said container encloses the entire top of said container.

18. The container of any one of claim 9 or 10 wherein the severable cover secured near the top periphery of said container is adhered to the center of the top.

19. The container of claim 9 or 10 wherein the severable cover comprises a polymeric sheet.

20. The container of any one of claims 9 or 10 wherein the severable cover comprises a sheet with a pre-stressed bias such that when the top and cover are severed the cover end becomes positioned away from said top and extends upwardly away from said top.

21. The cover of claim 9 or 10 is comprised of a metallic material.

22. The cover of claim 9 or 10 is comprised of a polymeric material.

23. The cover of claim 9 or 10 is comprised of a multilayered polymeric material.

24. The cover of claim 9 or 10 is comprised of a sheet of composite material of a polymer and non polymer such as polymer/metal, polymer/inorganic fiber.

* * * * *